United States Patent [19]

Kramer

[11] 4,190,691

[45] Feb. 26, 1980

[54] TROPHY PLAQUE

[75] Inventor: Marvin Kramer, Glenview, Ill.

[73] Assignee: The Alenite Corporation, Glenview, Ill.

[21] Appl. No.: 955,364

[22] Filed: Oct. 27, 1978

[51] Int. Cl.[2] ..... B44C 5/04; G09F 7/02

[52] U.S. Cl. ..... 428/67; 40/152; 40/158 R; 428/79; 428/156; 428/187

[58] Field of Search ..... 40/1.5, 27.5, 152, 152.1, 40/154, 158 R, 160; 156/303.1; 428/14, 31, 79, 67, 156, 157, 187; 35/26

[56] References Cited

U.S. PATENT DOCUMENTS

| | | | |
|---|---|---|---|
| 652,675 | 6/1900 | Hatton | 40/152 |
| 2,975,538 | 3/1961 | Murfin | 428/31 X |
| 3,301,728 | 1/1967 | Swartz | 428/157 X |
| 3,545,115 | 12/1970 | Nichols | 40/152.1 |
| 3,822,494 | 7/1974 | Zivica | 428/11 X |
| 3,949,506 | 4/1976 | Benkowski | 428/11 X |
| 3,986,283 | 10/1976 | Pelaez | 428/41 X |
| 4,125,655 | 11/1978 | Kanzelberger | 428/67 |

*Primary Examiner*—Henry F. Epstein
*Attorney, Agent, or Firm*—Vogel, Dithmar, Stotland, Stratman & Levy

[57] ABSTRACT

There is disclosed a trophy plaque comprising a slightly flexible plastic base adapted to be supported in an upright position and having an obverse surface with a recess formed therein. A decorative member is adapted to be press-fitted into the recess, the decorative member in turn having a second recess in its front face for receiving therein an adhesive-backed indicia label covered by a lens press-fitted into the second recess.

11 Claims, 5 Drawing Figures

TROPHY PLAQUE

BACKGROUND OF THE INVENTION

The present invention relates to a plaque of the type which may be used as a trophy or award or other token for recognizing noteworthy achievements in some field of endeavor.

Plaques are, in general, well-known in the art, but have typically been relatively expensive, particularly specialized and personalized plaques adapted for specific events or activities and bearing the identification of specific recipients. While less expensive plaques are available, they are typically of a stock or standard configuration and any specialized indicia or personalized information would have to be separately added at additional expense. If a user had several different types of activities or events for which he wished to provide plaques, he would have to have the different types individually custom-designed.

SUMMARY OF THE INVENTION

The present invention provides an improved inexpensive plaque of simple and economical construction which permits selection and assembly by the user of the decoration and indicia format which he desires.

It is a general object of this invention to provide an improved plaque of the character described which includes a base and a plurality of decorative and indicia members removably mountable on the base.

It is another object of this invention to provide a plaque of the character described, wherein the finished plaque can be assembled without the use of any tools.

These and other objects are achieved by providing a plaque comprising a base having an obverse surface, the obverse surface having a recess formed therein, and a decorative member having a front face and a rear face and including mounting means extending rearwardly from the rear face, the mounting means being adapted to be press-fitted into the recess for mounting the decorative member on the base with the rear face of the decorative member against the obverse surface of the base and with the front face of the decorative member exposed to view.

Further features of the invention pertain to the particular arrangement of the parts of the plaque whereby the above-outlined and additional operating features thereof are attained.

The invention, both as to its organization and method of operation, together with further objects and advantages thereof, will best be understood by reference to the following specification taken in connection with the accompanying drawings.

DESCRIPTION OF THE PREFERRED EMBODIMENT

Figure 1:
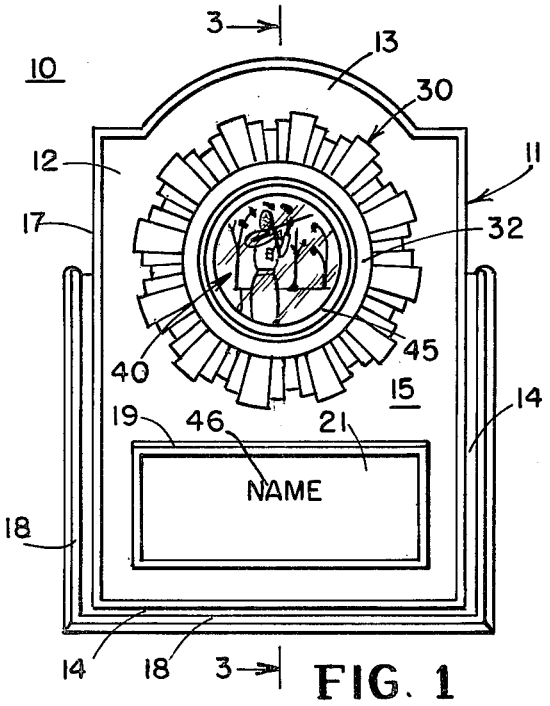
FIG. 1 is a front elevational view of a plaque constructed in accordance with and embodying the features of the present invention.
Figure 2:
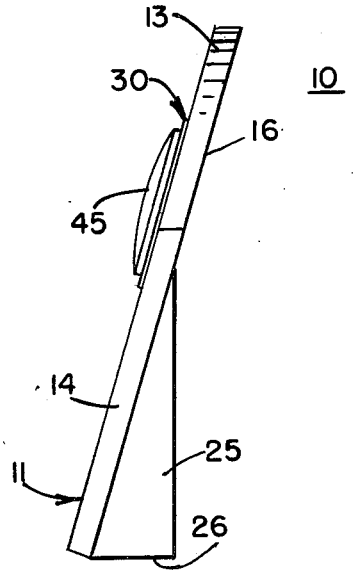
FIG. 2 is a side elevational view of the plaque of FIG. 1.
Figure 3:
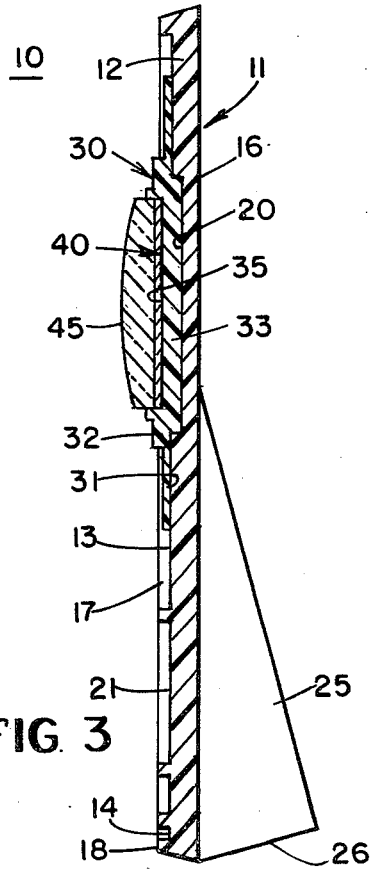
FIG. 3 is an enlarged view in vertical section taken along the line 3—3 in FIG. 1.
Figure 4:
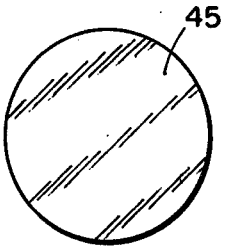
FIG. 4 is a front elevational view of the lens of the plaque illustrated in FIG. 3.
Figure 5:
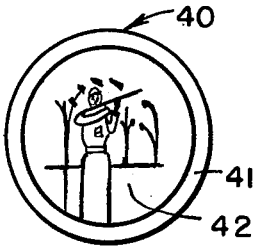
FIG. 5 is a front elevational view of the indicia label of the plaque illustrated in FIG. 3.

Referring now to FIGS. 1 through 3 of the drawings, there is illustrated a plaque, generally designated by the numeral 10, constructed in accordance with and embodying the features of the present invention. The plaque 10 includes a base, generally designated by the numeral 11, which has substantially rectangular main body portion 12 having an arcuate portion 13 at the top end thereof, and a marginal portion 14 extending outwardly from the bottom edge and the lower portions of the opposite side edges of the main body portion 12. The base 11 has a flat planar obverse surface 15 and a flat rear surface 16 substantially parallel to the obverse surface 15.

Extending forwardly from the main body portion 12 around the entire perimeter thereof is a short peripheral wall or ridge 17. Similarly, a marginal wall or ridge 18 extends along the entire length of the marginal portion 14 of the base 11 substantially parallel to the adjacent portions of the ridge 17. Disposed within the ridge 17 is a smaller auxiliary rectangular ridge 19 which defines an auxiliary rectangular region 21 of the obverse surface 15 for a purpose to be described more fully below. Also formed in the obverse surface 15 of the base 11 adjacent to the upper end thereof is a circular recess 20.

Integral with the rear surface 16 of the base 11 and extending rearwardly therefrom adjacent to the opposite side edges thereof are two generally triangular support members 25, each having a support edge 26 at the lower end thereof which is inclined at an acute angle to the rear surface 16 of the base 11 and is adapted for cooperation with the bottom edge of the base 11 for defining a support surface for supporting the base 11 in a substantially upright configuration on a table or the like, as best illustrated in FIG. 2.

There is also provided a decorative member such as an emblem or the like, generally designated by the numeral 30, which may be of any desired shape but, in the embodiment illustrated, is generally in the shape of a relatively flat disc having a rear face 31 and an irregular front face 32. Projecting rearwardly from the rear face 31 centrally therof is a circular hub or mounting portion 33. Formed in the front face 32, preferably centrally thereof, is a circular front recess 35. The mounting portion 33 is dimensioned so as to be press- or snap-fitted into the recess 20 in the obverse surface 15 of the base 11 for mounting the decorative member 30 on the base 11, as best illustrated in FIGS. 1 and 3. Preferably, the base 11 is formed of a material which has sufficient flexibility so that it can be slightly flexed to facilitate disengagement of the decorative member 30 from the base 11, as by popping the mounting portion 33 from the recess 20.

The plaque 10 preferably also includes an indicia member, generally designated by the numeral 40, shaped and dimensioned to be received in the front recess 35 of the decorative member 30. The indicia member 40 has a front face 41 on which is depicted a picture 42 or other suitable indicia. The indicia member 40 may be provided with a pressure-sensitive adhesive on the rear surface thereof, covered with a suitable peelable release liner, as is well known in the art, so that a supply of the indicia members 40 may be easily stored and, when it is desired to mount one in the decorative member 30, the release liner is removed to permit adhesive mounting of the indicia member 40 in the front recess 35.

Preferably, the indicia member 40 is covered, in use, by a transparent optical member such as a lens 45, which is shaped and dimensioned to be press- or snap-fitted into the front recess 35 of the decorative member 30 to cover and protect the indicia member 40 while permitting its visibility from the front of the plaque 10.

In a constructural example of the plaque 10, the base 11 is formed of plastic, and may be made in a unitary single-piece construction, as by molding. Likewise, the decorative member 30 may be molded of plastic. It will be appreciated that both the base 11 and the decorative member 30 may be constructed in any shape or size desired, the particular shape and size described herein being merely illustrative.

The indicia member 40 is preferably in the form of a label or the like and will be constructed of a size and shape to fit within the front recess 35 of the decorative member 30, it being appreciated that this front recess 35 could be of any desired size and shape. Typically, the indicia 42 might be a picture symbolic of or pertinent to the particular event or activity in connection with which the plaque is being used. Thus, if the plaque is to be used as a trophy or award for trap or skeet shooting, a picture of a trapshooter might be depicted thereon. But it will be understood that any pictorial or alphanumeric display or any other type of indicia desired could be utilized. The lens 45 may be formed of plastic or glass.

If desired, additional indicia 46 such as identification of the event or the name of the recipient may be mounted in the region 21 defined by the auxiliary ridge 19 on the obverse surface 15 of the base 11. It will be appreciated that these additional indicia 46 could also be of the adhesive-backed label or decal type of construction used for the indicia member 40. It will also be understood that the auxiliary region 21 could be of any desired size or shape.

It can thus be appreciated that in use, the plaque 10 affords a simple and economical construction affording unique advantages of design flexibility. By the use of this novel plaque 10, the ultimate user can design and assemble his own plaque. In this regard, there may typically be provided an assortment of different types of decorative members 30 and indicia members 40 suitable for different types of events or activities. Also, if desired, the decorative member 30 could be adhesively secured in the recess 20. The versatility of this plaque construction, as well as the economical construction thereof, also permits use of the plaque 10 as a novelty item.

While there has been described what is at present considered to be the preferred embodiment of the invention, it will be understood that various modifications may be made therein, and it is intended to cover in the appended claims all such modifications as fall within the true spirit and scope of the invention.

What is claimed is:

1. A plaque comprising a base having an obverse surface, said obverse surface having a recess formed therein, a decorative member having a front face and a rear face and including mounting means extending rearwardly from said rear face, said mounting means being adapted to be press-fitted into said recess for mounting said decorative member on said base with said rear face of said decorative member against said obverse surface of said base and with said front face of said decorative member exposed to view, said decorative member having a second recess formed in said front face thereof, and indicia means disposed in said second recess.

2. The plaque of claim 1, wherein said recess and said mounting means are substantially circular in shape.

3. The plaque of claim 1, wherein said base is sufficiently flexible to permit flexing thereof to facilitate disengaging said mounting means from said recess.

4. The plaque of claim 1, and further including support means connected to said base for supporting said base in an upright position.

5. The plaque of claim 1, and further including ridge means projecting forwardly from said obverse surface and cooperating therewith to define an enclosed region for mounting auxiliary decorative or indicia means.

6. A plaque comprising a base having an obverse surface, said obverse surface having a first recess formed therein, a decorative member having a front face and a rear face and including mounting means extending rearwardly from said rear face, said mounting means being adapted to be press-fitted into said first recess for mounting said decorative member on said base with said rear face of said decorative member against said obverse surface of said base and with said front face of said decorative member exposed to view, said decorative member having a second recess formed in said front face thereof, indicia means disposed in said second recess, and a transparent optical member adapted to be press-fitted into said second recess for covering said indicia means while permitting viewing thereof.

7. The plaque of claim 6, wherein said first recess and said mounting means are substantially circular in shape.

8. The plaque of claim 6, wherein said first and second recesses and said mounting means and said optical member are all substantially circular in shape.

9. The plaque of claim 6, wherein said indicia means comprises a separate indicia member disposable in said second recess.

10. The plaque of claim 6, wherein said indicia means comprises an adhesive-backed label adapted to be adhesively secured to said decorative member in said second recess.

11. The plaque of claim 6, wherein said optical member comprises a lens.

* * * * *